United States Patent [19]

DeVille

[11] Patent Number: 5,020,631

[45] Date of Patent: Jun. 4, 1991

[54] MODULAR SILENCER

[75] Inventor: Paul DeVille, Bonneville, France

[73] Assignee: Devil, société anonyme, Bonneville, France

[21] Appl. No.: 505,926

[22] Filed: Apr. 6, 1990

[30] Foreign Application Priority Data

Apr. 25, 1989 [FR] France ..... 89 05937

[51] Int. Cl.[5] ..... F01N 1/02

[52] U.S. Cl. ..... 181/249; 181/252

[58] Field of Search ..... 181/247–252, 181/255, 243

[56] References Cited

U.S. PATENT DOCUMENTS

| | | | |
|---|---|---|---|
| 2,041,767 | 5/1936 | Jack, 3rd | 181/248 |
| 2,205,024 | 10/1945 | Zinsitz . | |
| 3,381,774 | 5/1968 | Stade . | |
| 3,670,845 | 6/1972 | Betts . | |
| 3,941,206 | 3/1976 | Halter . | |
| 4,164,266 | 8/1979 | Collin et al. | 181/250 |
| 4,456,091 | 6/1984 | Blanchot | 181/243 X |
| 4,854,417 | 8/1989 | Uesugi et al. | 181/243 X |

FOREIGN PATENT DOCUMENTS

| | | |
|---|---|---|
| 0056604 | 12/1982 | European Pat. Off. . |
| 402357 | 9/1924 | Fed. Rep. of Germany . |
| 2623153 | 5/1976 | Fed. Rep. of Germany . |
| 3509033 | 9/1986 | Fed. Rep. of Germany . |
| 1149838 | 1/1958 | France . |
| 1188197 | 9/1959 | France . |

*Primary Examiner*—Brian W. Brown

*Attorney, Agent, or Firm*—Ratner & Prestia

[57] ABSTRACT

A silencer is disclosed comprising an external case (1) formed by assembling together a first case element (14) and a second case element (15) each formed of a continuous wall comprising a tubular axial portion and an end radial portion (3, 4). The elements (14, 15) are obtained by deep drawing. They are assembled axially together by peripheral welding on the intermediate peripheral connecting zone (30) formed by their two edges (17, 32) applied against each other and bearing on an inner support piece (13).

12 Claims, 5 Drawing Sheets

MODULAR SILENCER

BACKGROUND OF THE INVENTION

1. Field of the Invention

The present invention has as object a range of exhaust silencers or mufflers for internal combustion engines, which can be used particularly on vehicles such as motor cars and motor cycles.

A large number of silencers are already known for internal combustion engines. They generally comprise an external case forming a closed enclosure, pierced with at least two orifices for the inlet and outlet of exhaust gases respectively and adapted for connection to an inlet tube and an outlet tube conducting the gases. The closed case contains means for expanding the exhaust gases and conducting them between the inlet and outlet orifices.

2. Description of the Prior Art

The most widely used case structure, described for example in the document U.S. Pat. No. 3 337 939, comprises a tubular peripheral sidewall developed lengthwise along a longitudinal axis, said peripheral sidewall being connected at its ends to two transverse end walls by peripheral crimping forming a bead. Such a structure has the drawback of relatively short life, due particularly to the presence of the peripheral connecting crimping between the sidewall and the end walls, which crimping is formed in a zone forming a wedge in which chemical reactions take place which progressively attack the metal forming the cases. Furthermore, the external profile of such a silencer, having peripheral beads, leads to an increase of the overall diameter of the silencer, for a given inner volume, and the result is a reduction of the useful volume with respect to the total external volume and a reduction of efficiency. Also, this silencer structure is not adapted to the production of a range of silencers of different sizes: to produce two silencers of different lengths, it is necessary to provide longitudinal tubular peripheral cases of different lengths.

Another silencer structure is described in the document FR-A-2 467 974. In this document, the silencer is formed of an external protecting case comprising two semi-cylindrical half shells connected together along two flattened end generatrices, the corresponding generatrices being assembled together by crimping and thus forming two diametrically opposite beads occupying the whole length of the silencer. The external lateral beads increase the size of the silencer, for an equal internal volume. Furthermore, to produce a range of silencers of different lengths, it is necessary to provide half shells having the total length of each silencer. This structure is therefore not adapted to the construction of a range of silencers of different lengths.

The object of the present invention is to avoid the drawbacks of such traditional silencer structures, by providing a new structure which, from a limited number of standard elements, makes it possible to produce silencers whose lengths are different. For that, a more or less large number of different unitary elements are fitted axially end to end to produce silencers whose diameters are substantially identical but whose lengths depend on the number and structure of the assembled elements.

Silencer structures are already known formed by axially assembling end to end at least two unitary elements, each unitary element being formed of an axial peripheral sidewall defined at its upper end by a free annular edge and connected at its second end to a radial portion forming a silencer transverse end wall. Such structures are described particularly in the documents U.S. Pat. No. 2 205 024, DE-C-402 357, DE-A-2 623 153, U.S. Pat. No. 3 670 845.

It proves that a structure such as described in the document U.S. Pat. No. 2 205 024 is difficult to produce for the two free edges of the two parts to be assembled together are guided by no guide means during assembly thereof. The result is welding defects and a great manufacturing complexity.

The documents DE-C-402 357, DE-A-2 623 153 and U.S. Pat. No. 3 670 845 teach an assembly using an external sleeve covering externally the two edges of the elements to be assembled together. This structure is not adapted to assembly by welding, it increases the external size of the silencer and complicates manufacture, without giving satisfactory results from the point of view of sealing and mechanical strength of the assembly.

SUMMARY OF THE INVENTION

The object of the invention is to overcome these drawbacks by a particular structure permitting edge to edge welding of the silencer elements connected together axially end to end, the structure of the element alone ensuring guiding of the element edges with respect to each other during welding, so that the edges to be welded together are correctly and automatically centered. The welding obtained is of good quality and easy to carry out and sealing is improved.

The invention further makes it possible to hold the two edges to be welded in position from the inside, which makes it possible to apply centripetal forces on the edges during welding, without these forces moving them or deforming them.

The edge guiding means according to the invention permit a substantial increase of the tolerances of shape of the respective edges of the case elements and in particular make it possible to eliminate certain deformations or ovalness of these edges.

In some embodiments of the invention, the means for guiding the element edges with respect to each other during welding themselves provide other functions, such as a function of separating two compartments, or a function holding other elements in position inside the silencer.

The new silencer structure also increases the volume of the case for a constant external size, particularly by eliminating the peripheral or longitudinal beads which are met with in traditional structures.

The invention further increases the efficiency of the silencer and in particular reduces the expansion noises of the gases.

An important object of the invention is the increase of the useful life of the silencer, this increase being obtained by a particular structure reducing the danger of the metal forming the case being attacked, improving the vibration resistance and formed of materials insensitive to corrosion.

To attain these objects as well as others, the silencer structure according to the invention comprises an external case forming a closed enclosure, comprising:

at least a first case element formed of a continuous wall in which can be distinguished a tubular axial portion and a radial portion, the tubular axial portion being limited at its first end by a first free annular edge defining a plane substantially perpendicular to the longitudinal axis of the silencer, and connected at its second end to the radial portion forming a first transverse end wall of the silencer, at least a second case element, formed of a continuous wall comprising a tubular axial portion forming a portion of the axial peripheral sidewall of the silencer, the axial portion being defined at its first end by a second free annular edge defining a plane substantially perpendicular to the longitudinal axis of the silencer, of the same shape as said first edge and connected at its second end to a radial portion forming a transverse wall, said first and second case elements being assembled axially together in opposition, along an intermediate peripheral annular connection zone formed by said first and second free edges applied axially together edge to edge, said case elements being joined together sealingly along the whole periphery of their connection zone.

The two case elements are fixed together preferably for example by welding. In line with the intermediate peripheral annular connection zone, an inner piece with cylindrical periphery forms a connecting support against which bear simultaneously the two internal faces of the annular closed axial portions of the first and second case elements in the vicinity of said edges.

The fixing means such as welding may advantageously join together simultaneously the two edges of the first and second case elements and the support-forming internal piece.

In a preferred embodiment, the first and second case elements each form a part produced separately by axial shaping of a plate material, for example by flow turning, or planishing or deep drawing.

The tubular axial portion of one at least of the first and second case elements comprises an annular necking in the zone connecting to the radial portion. This necking defines a tubular axial zone of reduced section on which the first open end of another case element may fit with slight play.

BRIEF DESCRIPTION OF THE DRAWINGS

Other objects, features and advantages of the present invention will be clear from the following description of particularly embodiments, with reference to the accompanying drawings, in which.

DESCRIPTION OF THE PREFERRED EMBODIMENTS

Figure 1:
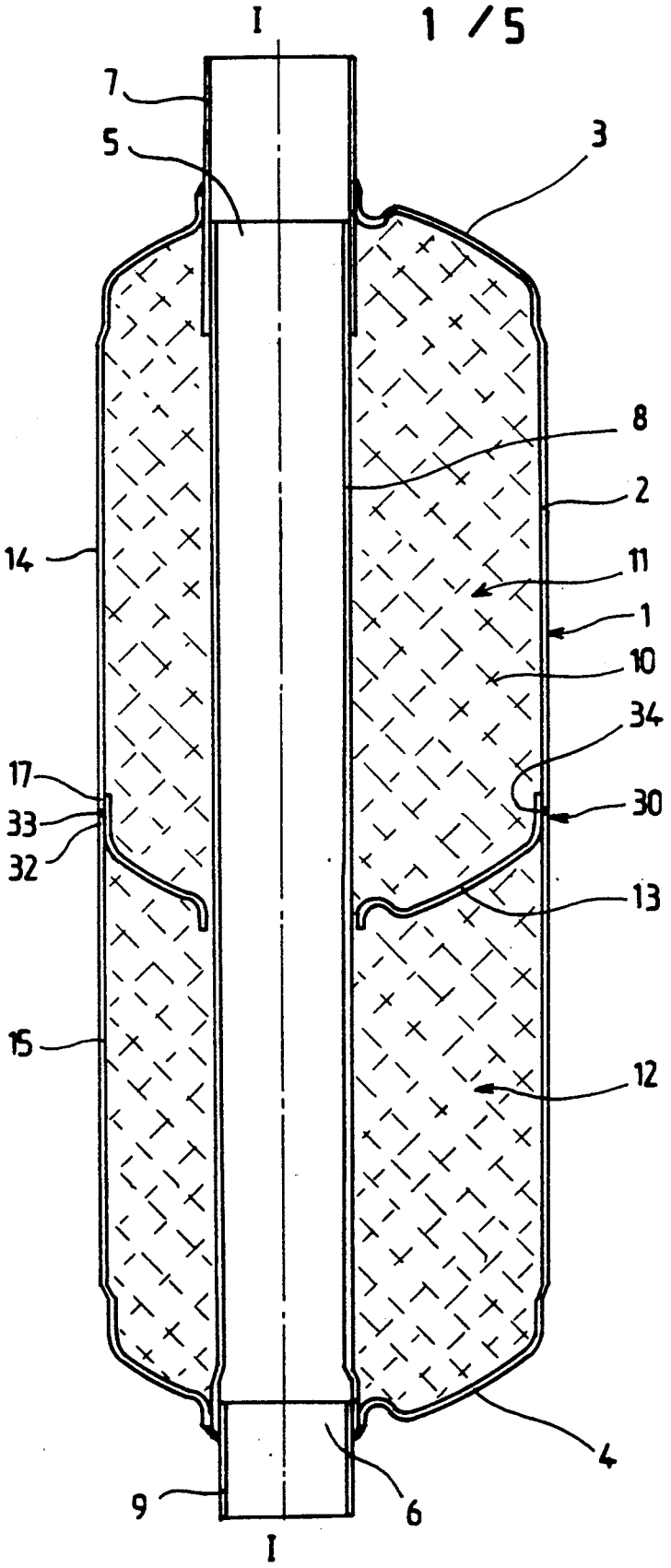
FIG. 1 is a longitudinal sectional view of the complete silencer in one embodiment of the invention.

In the embodiment shown in FIG. 1, the exhaust silencer according to the invention comprises an external case 1 forming a closed enclosure, defined by an axial peripheral wall 2 developed along a longitudinal axis I—I. The enclosure is closed at a first end by a first transverse end wall 3 and is closed at its second end by a second transverse end wall 4. In the embodiment shown, the first transverse end wall 3 is pierced with a first orifice 5 and the second transverse end wall 4 is pierced with a second orifice 6. A first end tube 7 fits in the first orifice 5. A perforated inner longitudinal tube 8 is fitted, by its first end, in the first end tube 7 and by its second end in the second orifice 6. A second end tube 9 is fitted in the second end of the perforated inner longitudinal tube 8. Thus, the perforated inner longitudinal tube 8 passes through case 1 from one side to the other. The space between the perforated inner longitudinal tube 8 and the external case 1 of the silencer is filled with material usually used in the manufacture of silencers, for example a fibrous material 10 such as basalt wool, stainless steel wool, or another fibrous material.

The inner space of the external case 1 is split into two compartments, a first compartment 11 and a second compartment 12, separated by a transverse intermediate wall 13. The transverse intermediate wall 13 connects an intermediate zone of the external case 1 and an intermediate zone of the perforated inner longitudinal tube 8 together, as shown in the figure.

The present invention concerns in particular the structure and form of the external case 1 and of the transverse internal wall 13, so as to fulfil the aims of the invention.

For this, in FIG. 1 it will be noted that the external case 1 is formed of two main parts, namely a first case element 14 forming substantially the case of the first compartment 11, and a second case element 15 forming substantially the case of the second compartment 12. The two case elements 14 and 15 have the same shape and this shape is shown in greater detail in FIG. 2.

Figure 2:
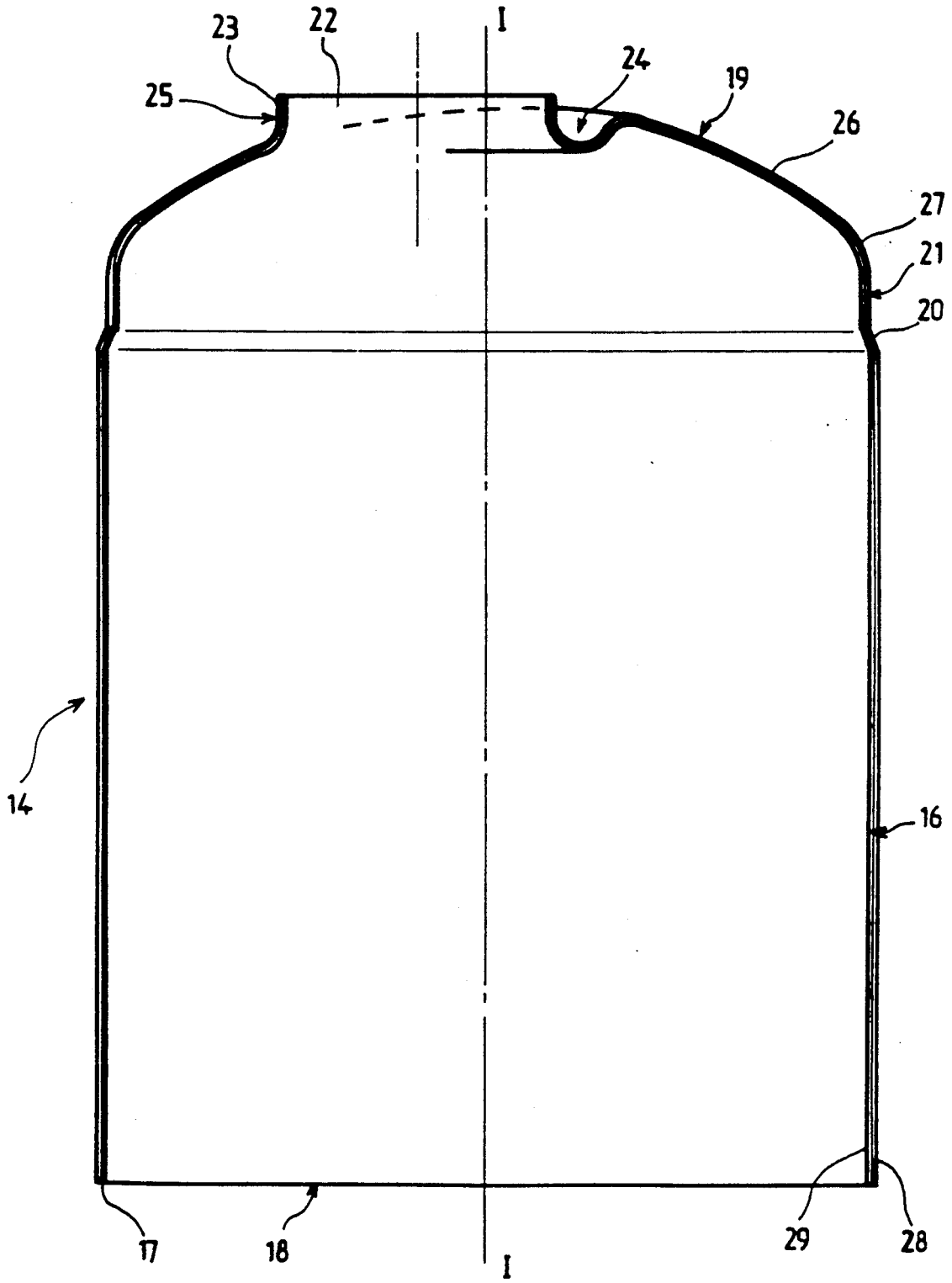
FIG. 2 is a longitudinal sectional view of a case element according to the invention.

Referring now to FIG. 2, showing a case element 14 according to the invention, it can be seen that the case element is formed of a continuous wall comprising an axial tubular portion 16, forming a portion of the peripheral wall 2 of the silencer, the axial portion being defined at its first end by a free annular edge 17 located in a plane 18 substantially perpendicular to the longitudinal axis I—I of the case element. The axial portion 16 is connected at its second end to a radial portion 19 forming one of the transverse end walls of the silencer. In the connection zone to the radial portion 19, the tubular axial portion 16 comprises an annular necking 20, as shown in FIG. 2, defining a tubular axial zone 21 of smaller section than the rest of the axial portion 16. The tubular axial zone 21 has a section such that another case element identical to the element shown in FIG. 2 may be fitted on said tubular axial zone 21 by its open end corresponding to its annular edge 17, fitting taking place with slight play. In other words, the necking 20 corresponds substantially to the thickness of the wall forming the axial portion 16.

The radial portion 19 is pseudo-spherical with outwardly turned convexity and, in the embodiment shown, comprises an orifice 22 for fitting the gas passage tube. Orifice 22 comprises a projecting tubular lip 23 forming a cylinder with axis substantially parallel to the longitudinal axis I—I. The tubular lip 23 is connected to the radial portion 19 by a peripheral zone of special shape: on at least a part of its periphery, said peripheral zone forms an external groove 24 formed by the curvature of the wall forming the radial portion, as shown in FIG. 2. For example, groove 24 may have a semicircular section with a radius equal to about 5 mm. In the embodiment shown, orifice 22 is off-centered with respect to the longitudinal axis I—I of the case element. In this case, groove 24 only occupies a part of the periphery of the tubular lip 23, namely the portion close to the longitudinal axis I—I. The external portion 25, further away from the longitudinal axis I—I, is connected by a simple rounding as shown in the figure. Groove 24 forms an intermediate zone of deformation between the tubular lip 23 and the radial portion 19 and allows small variations of axial orientation of tubular lip 23 with respect to the longitudinal axis I—I. This possibility permits the orientation, in a relatively but nonetheless sufficient range, of the gas passage tubes with respect to the silencer. These variations of orientation make it possible to follow the variations of dimensions due to heating of the materials during use, heating caused by the burning gases leaving the internal combustion engine.

The presence of groove 24 makes possible the use of bellied or convex walls 3 and 4 which promote aerodynamism and corrosion resistance, without a substantial loss of volume with respect to a cylindrical case with flat ends.

The presence of groove 24 further increases the useful length of tubular lip 23, for correct fitting of a gas passage tube in said lip 23, without increasing the overall length of the case element.

The radial portion 19, in the embodiment shown, is formed of an intermediate portion 26 with relatively large radius, for example 120 mm, connected to the tubular axial zone 21 by an annular rounded portion 27 with smaller radius, for example 15 mm. The tubular axial zone 21 has a sufficient length, for example 10 mm or so, for correct fitting of one case element on the other.

The wall of the case element is advantageously formed of several thin sheets in contact with each other and shaped together by axial shaping. In the embodiment shown in FIG. 2, an external sheet 28 and an internal sheet 29 can be seen. The shaping of the external 28 and internal 29 sheets takes place at the same time, for example by deep drawing, flow turning or planishing. With these techniques a blind tubular case element may for example be produced having a diameter of about 150 mm, for a length of about 220 mm. Two sheets 28 and 29 of austenitic type stainless steel may advantageously be used, of grade 304. The two sheets 28 and 29 form a double skin substantially reducing the transmission of sound waves outwardly of the enclosure. In other embodiments, other multi-layer materials may advantageously be used, for example a stainless steel sheet - stainless steel fabric pair, or for example a stainless steel sheet - elastomer - steel sheet stack. The construction may also be made from a non metallic material: molded technical plastic, carbon fiber based composite or other composites withstanding the thermal stresses.

To construct the silencer shown in FIG. 1, two case elements are used such as the element shown in FIG. 2, namely the first case element 14 and the second case element 15. The two case elements 14 and 15 are oriented oppositely and assembled axially together in opposition, as shown in FIG. 1, along an intermediate peripheral connection zone 30 formed by the annular edge 17 of the first element 14 and the annular edge 32 of the second element 15 applied axially edge to edge one against the other. A fixing means 33, such as laser or plasma welding, joins the two edges 17 and 32 sealingly together along the whole periphery of their connection zone 30. Fixing may also be achieved by a means 33 such as bonding, bond-welding, crimping.

In the embodiment shown, the axial tubular portions of the first and second case elements are cylindrical and have the same sections, so as to form a cylindrical axial peripheral silencer sidewall, the term "cylindrical" must be understood in the wide mathematical sense, the section may be circular, oval or other.

In line with the intermediate peripheral connection zone 30 is disposed an inner support piece formed, in the embodiment shown, by the transverse intermediate wall 13. Said inner piece forming the transverse intermediate wall 13 is shaped so as to form a connecting support, against which bear simultaneously the two internal faces of the tubular axial portions of the first case element 14 and of the second case element 15 in the vicinity of their respective edges 17, 32. For that, the inner piece forming the transverse intermediate wall 13 comprises a peripheral surface 34 whose shape corresponds to the inner periphery shape of edges 17 and 32 so as to provide narrow contact.

The transverse intermediate wall 13 may advantageously be formed by a piece having the same shape as the radial portion 19 and the tubular axial portion 21 of the case element shown in FIG. 2. Thus, this intermediate piece 13 may be made with the same tools as those used for forming the end of the case element of FIG. 2. The advantages offered by this solution for standardizing the production will be readily understood. The fixing means 33 are advantageously used for simultaneously fixing the two edges 17 and 32, and the cylindrical peripheral portion 34 of the transverse inner wall 13.

According to another possibility, in line with the intermediate peripheral connection zone 30 may be disposed an internal support piece formed of a simple hoop or cylindrical annular element. The hoop has a sufficient length to form a connecting support, against which bear simultaneously the two inner faces of the edges of the tubular axial portions of the first case element 14 and of the second case element 15. The hoop has a peripheral surface 34 whose shape corresponds to the inner periphery of edges 17 and 32, so as to provide a narrow contact. Thus, the hoop does not divide the silencer into two compartments, but only fulfils the functions of supporting and guiding the respective edges 17 and 32 of the case elements.

The following figures illustrate the modular character of the silencer structure according to the invention. They show how, from a very reduced number of elementary parts, a varied range of silencers may be produced having different lengths, and in which the external case has the general structure shown in FIG. 2.

Figure 3:
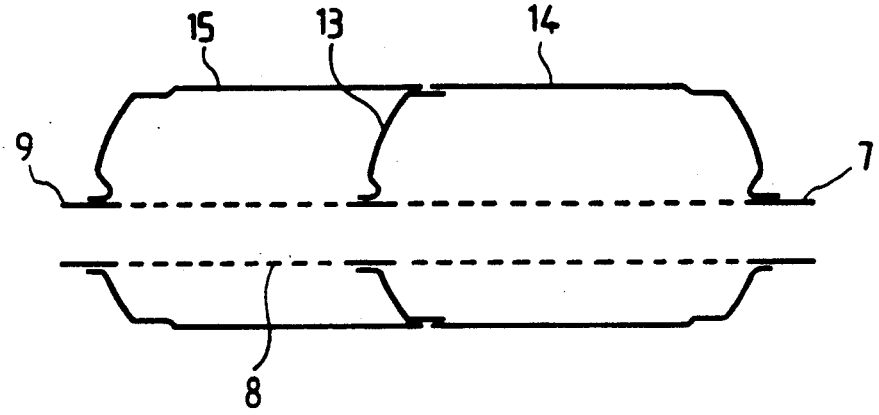
FIG. 3 is a schematic longitudinal sectional view of a silencer according to the invention, in one embodiment with two case elements.

Thus, in FIG. 3, the structure of the silencer of FIG. 1 is shown schematically, with a first case element 14, a second case element 15, a tubular intermediate wall 13, a perforated inner longitudinal tube 8 and two end tubes 7 and 9.

Figure 4:
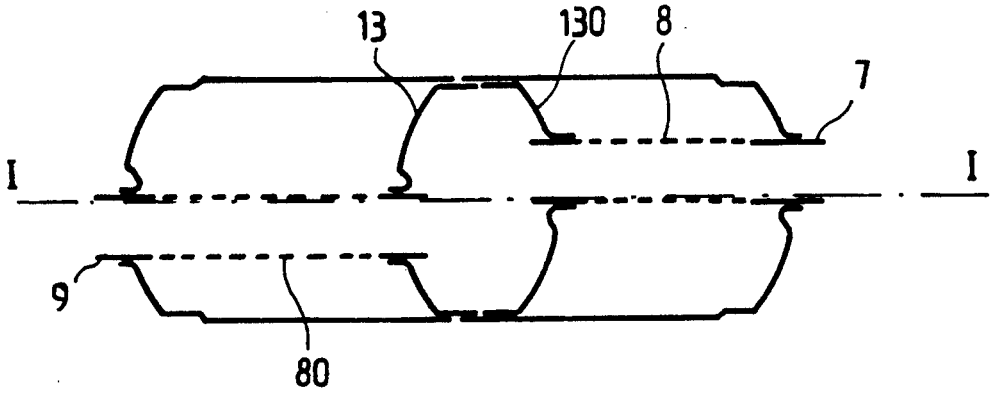
FIG. 4 is another embodiment, seen in longitudinal section, of a silencer according to the invention with two case elements.

The silencer shown in FIG. 4 shows substantially the same structure with however a difference: the orifice corresponding to the first end tube 7 is offset on a first side with respect to the longitudinal axis I—I of the silencer, whereas the orifice corresponding to the second end tube 9 is offset in the other direction. In this case, a first perforated inner longitudinal tube 8 is held in position on the one hand by the first end tube 7 and on the other by an intermediate wall 130, reversed with respect to the intermediate wall 13, and of the same shape. A second perforated inner longitudinal tube 80 is held on the one hand by the second end tube 9 and on the other by the transverse inner wall 13.

Figure 5:
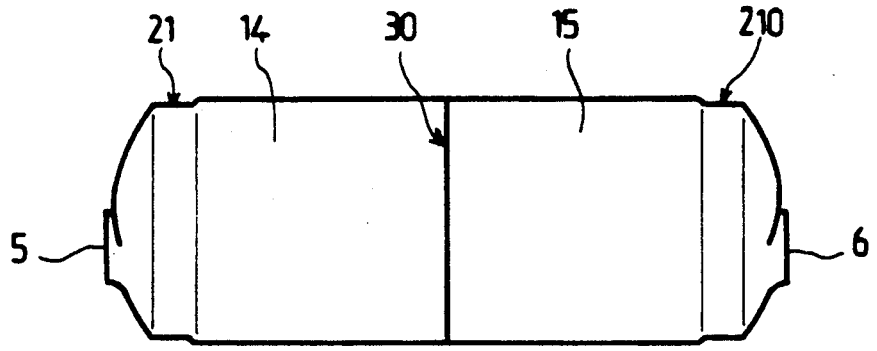
FIGS. 5, 6 and 7 illustrate three other embodiments of the silencer according to the invention with two case elements.

In FIG. 5, the external appearance of a silencer has been shown in the embodiment of FIG. 1. There can be seen the first orifice 5, the second orifice 6 and the intermediate peripheral connection zone 30 between the first case element 14 and the second case element 15. The tubular axial zone 21 of the first case element 14 and the corresponding tubular axial zone 210 of the second case element 15 form two end zones of reduced diameter. These two zones may advantageously receive marking collars so that said collars, when they are in position on zones 21 and 210, do not project from the outer diameter of the case.

Figure 6:
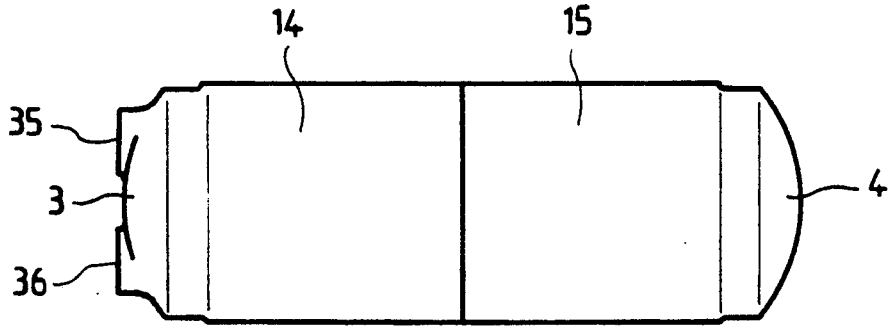

In FIG. 6, a variant has been shown in which the first case element 14 comprises, on its first transverse end wall 3, two orifices 35 and 36 for respectively the combustion gas inlet and outlet, whereas the second case element 15 comprises a second closed transverse end wall 4.

Figure 7:
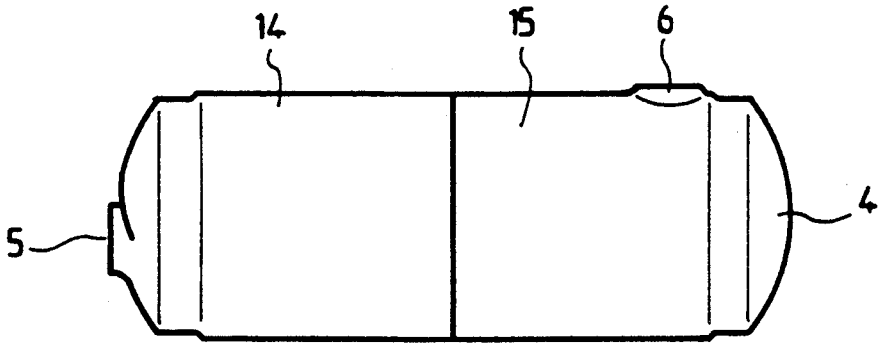

In the embodiment of FIG. 7, the first case element 14 is identical to that of FIG. 5 whereas the second case element 15 comprises a second orifice 6 disposed not in the second transverse end wall 4, which is closed, but in the lateral peripheral wall.

Figure 8:
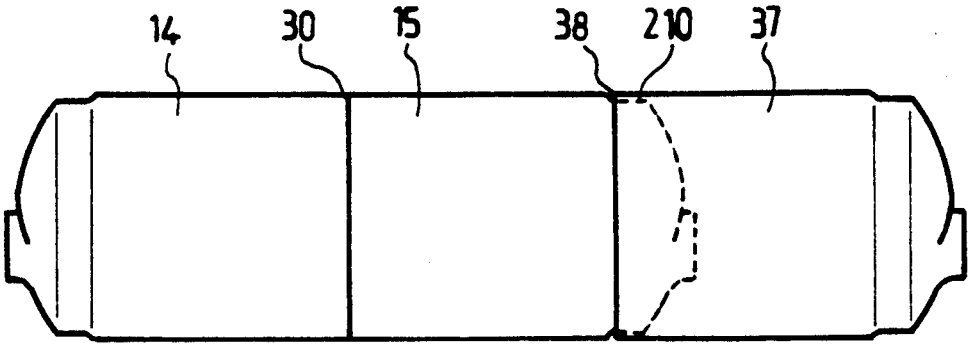
FIG. 8 illustrates one embodiment of the invention with three case elements.

In the embodiment of FIG. 8, the silencer comprises a first case element 14 and a second case element 15 associated in the same way as in the embodiment of FIG. 5, with welding in the intermediate peripheral connection zone 30. Furthermore, a third case element 37, identical to that shown in FIG. 2, is fitted on the axial zone 210 of the second case element 15 by its open end, thus extending the assembly formed by the first two case elements 14 and 15. Welding secures the third case element 37 to the second case element 15, along the whole periphery of the end edge 38 of said third case element 37.

Figure 9:
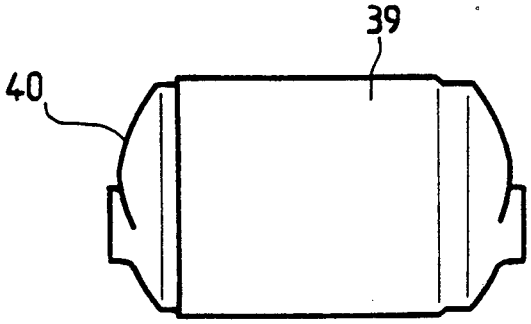
FIG. 9 illustrates one embodiment of the silencer comprising a first case element of great length and a second case element of small length.

In FIG. 9, the silencer is formed of a first case element 39 identical to that shown in FIG. 2, of relatively great length, associated with a second case element 40 of much smaller length. For example, the second case element 40 may be formed by a part having the same shape as the transverse intermediate wall 13 shown in FIG. 1, namely comprising a radial portion 19 of FIG. 2 and a tubular axial zone 21.

Figure 10:
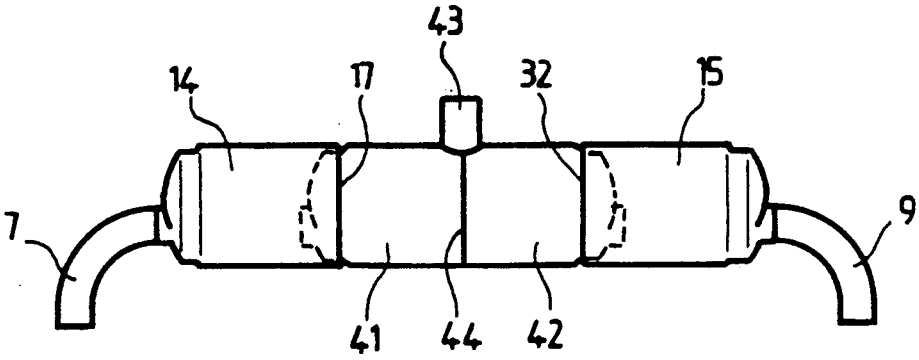
FIG. 10 illustrates one embodiment of the silencer according to the invention with four case elements.

In FIG. 10, an embodiment has been shown with four case elements associated longitudinally together, namely: a first case element 14, a second case element 15 forming respectively the two ends of the silencer and fitted to end tubes 7 and 9. The first case element 14 is fitted by its edge 17 on the tubular axial zone of smaller section of a third case element 41 itself welded edge to edge along the peripheral welding zone 44 to a fourth case element 42 itself receiving, on its tubular axial zone of reduced section, the edge 32 of the second case element 15. A lateral gas passage orifice 43 is provided in the welding zone 44 between the case elements 41 and 42.

It will be readily understood that other variants may be devised, for example by providing case elements of different lengths which may be associated together and produce silencers whose lengths may be chosen in a relatively continuous range of lengths.

It will be understood that the invention is compatible not only with the internal structures of silencers having a perforated through tube, as shown in the figures, but also with any other internal silencer structure. It is possible for example to use an internal structure comprising a HELMOLTZ resonator providing high sound attenuation about a nominal frequency, for example between 80 and 100 Hz.

The present invention is not limited to the embodiments which have been explicitly described but includes the different variants and generalizations thereof contained within the field of the following claims.

I claim:

1. An exhaust silencer for transferring exhaust gases from an inlet tube to an outlet tube, comprising an outer case forming a closed enclosure defined by an axial peripheral sidewall developed along a longitudinal axis and first and second transverse end walls, the case being pierced with at least one inlet orifice and one outlet orifice respectively for the inlet and outlet of the exhaust gases and adapted for connection of an inlet tube and an outlet tube, the case containing means for the expansion of the exhaust gases and conduction thereof between the inlet and outlet orifices, the case comprising:

at least a first case element formed of a continuous wall comprising a first tubular axial portion forming a portion of said axial peripheral sidewall between a first end and a second end of the first tubular axial portion, the axial portion being limited at its first end by a first free annular edge and being connected at its second end to a radial portion forming said first transverse end wall, at least a second case element, formed of a continuous wall comprising a second tubular axial portion forming a portion of said axial peripheral sidewall, the axial portion being defined at its first end by a second free annular edge and being connected at its second end to a radial portion forming a transverse wall, the first and second free annular edges of the respective first and second case elements being configured similarly, said first and second case elements being assembled axially together in opposition, along an intermediate peripheral annular connection zone formed by said first and second edges applied axially together edge to edge, said case elements being joined together sealingly along the peripheral annular connection zone, in line with the intermediate radial annular connection zone, an inner piece with cylindrical peripheral surface forming a connecting support against which bear simultaneously two inner faces of the tubular axial portions of the first and second case elements.

2. The silencer as claimed in claim 1, wherein the two edges of the first and second case elements and the inner piece are joined by means for bonding the case elements, said bonding means selected from the group consisting of: welding, bonding, bond-welding and crimping.

3. The silencer as claimed in claim 1, wherein the first and second case elements each form a part produced separately by axial shaping of a plate material.

4. The silencer as claimed in claim 1, wherein the inner piece forms a transverse wall separating two distinct silencer compartments.

5. The silencer as claimed in claim 1, wherein the tubular axial portion of one at least of the first or second case elements comprises an annular necking in the zone connecting to the radial portion, defining a tubular axial zone of reduced section on which the first open end of a case element may fit with slight play.

6. The silencer as claimed in claim 5, wherein the inner piece forming a transverse wall comprises a tubular axial zone and a radial portion identical respectively to the tubular axial zone of reduced section and the radial portion of a case element, said inner piece tubular axial zone forming a connecting support.

7. The silencer as claimed in claim 5, wherein the end walls of the silencer are convex and pseudo-spherical, and comprise at least one orifice for fitting a gas passage tube, and each orifice comprises a projecting tubular lip connected to the end wall by a reinforcement zone forming an external groove with rounded section formed on said end wall on at least a peripheral portion of said lip so that said reinforcement zone forms an intermediate deformation zone between the tubular lip and the end wall and allows the small variations of axial orientation between the silencer and a gas passage tube engaged in said lip.

8. The silencer as claimed in claim 7, wherein the wall of the case elements is formed of two thin sheets of stainless steel in contact with each other.

9. The silencer as claimed in claim 1, wherein two identical case elements are assembled together in opposition and with an intermediate wall.

10. The silencer as claimed in claim 1, wherein a first case element comprises an elongate tubular portion and a second case element has a shorter tubular portion.

11. The silencer as claimed in claim 9, further comprising a third case element formed of a continuous wall comprising a third tubular axial portion forming a portion of said axial peripheral side wall between a first end and a second end of the third tubular axial portion, the axial portion being limited at its first end by a first free annular edge forming an open end, and being connected at its second end to a radial portion forming a transverse end wall, said third case element being connected by its open end to the tubular axial zone of reduced section of one of the other two elements.

12. The silencer of claim 8, wherein the wall of the case elements is formed by deep drawing the two stainless steel sheets.

* * * * *